US005193693A

United States Patent [19]

Miragliotta

[11] Patent Number: 5,193,693

[45] Date of Patent: Mar. 16, 1993

[54] ARTICLE SUPPORT STAND

[76] Inventor: Anthony Miragliotta, 452 Ridge Rd., Fredon Township, Newton, N.J. 07860

[21] Appl. No.: 864,576

[22] Filed: Apr. 7, 1992

[51] Int. Cl.[5] ..... A47F 7/00

[52] U.S. Cl. ..... 211/69.5; 211/164

[58] Field of Search ..... 211/69.5, 164, 163, 211/74, 70

[56] References Cited

U.S. PATENT DOCUMENTS

| | | | |
|---|---|---|---|
| 846,133 | 3/1907 | McIntyre | 211/164 X |
| 2,450,180 | 9/1948 | Bixer | 211/164 X |
| 2,715,025 | 8/1955 | Drake | 211/164 X |
| 3,273,846 | 9/1966 | De Maré | 211/69.5 X |

*Primary Examiner*—Blair M. Johnson

[57] ABSTRACT

An article support stand including at least one article support member provided with, for example, a plurality of recesses for receiving and retaining a plurality of articles, at least a pair of wall members, and interconnecting means for removably and rotatably interconnecting the article support member between the wall members, such interconnecting means include a generally semi-circular disc-like male connecting member and a generally cylindrical female connecting member providing a recess for rotatably receiving the male connecting member and the female connecting member being further provided with retaining means for retaining the male connecting member within the recess upon the male connecting member being received within the recess and rotated with respect to the female connecting member. The article support stand has modularity in that the female connecting members are provided on both sides of the wall members making them interchangeable and permitting each wall member to function as either a right, left or intermediate wall member.

6 Claims, 3 Drawing Sheets

ARTICLE SUPPORT STAND

BACKGROUND OF THE INVENTION

This invention relates generally to a new and improved support stand for receiving and retaining articles such as for example markers, pens and pencils, and more particularly relates to a modular support stand whose modularity permits the stand to expand in building block fashion to receive and retain additional articles as may be desired or required. The retention of the articles may be such as to display them for sale or for ready access by an artist or draftsman.

SUMMARY OF THE INVENTION

The article support stand of the present invention includes at least one article support member provided, for example, with a plurality of recesses for receiving and retaining a plurality of articles, and further includes at least one pair of end wall members. The article support member is interconnected removably and rotatably between the end wall members by a pair of semi-circular disc-like male members provided, preferably, on opposed ends of the article support member, and a pair of generally cylindrical female members provided, preferably on the sides of the pair of end wall members. The cylindrical female members provide a recess for rotatably receiving and retaining the male members upon the male members being received within the recesses and rotated with respect to the female members. The article support stand of the present invention is also modular permitting expansion of the support stand in building block fashion to accommodate the retention of additional articles. Such modularity is accomplished in the preferred embodiment by providing the female members on both sides of the end wall members whereby the end wall members are interchangeable and each end wall member may function as either a right or left extreme wall member or as an intermediate wall member.

DESCRIPTION OF THE PREFERRED EMBODIMENT

Figure 1:
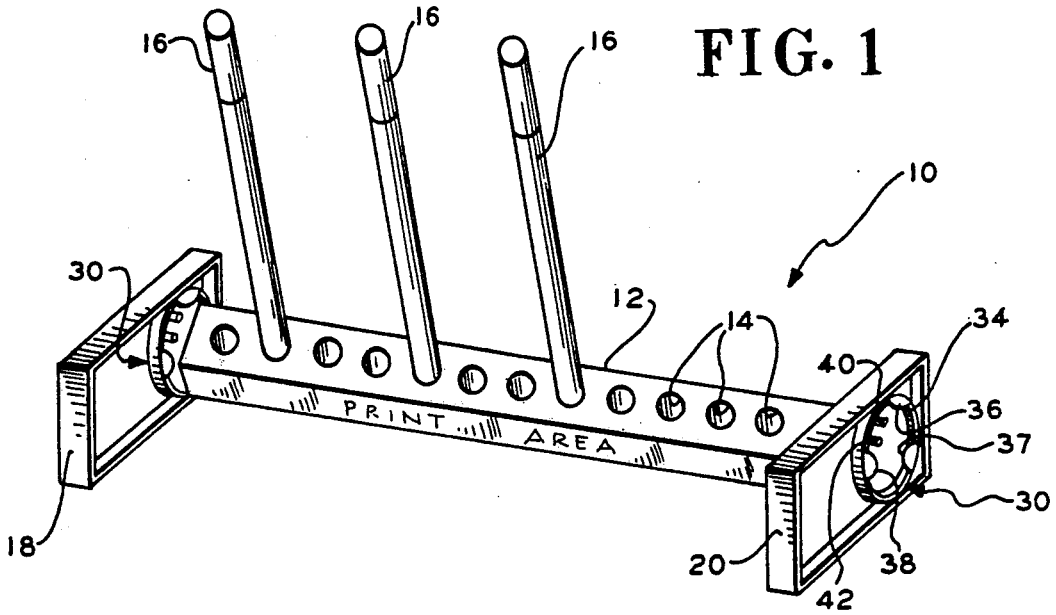
FIG. 1 is a perspective view of an article support stand embodying the present invention and illustrating a plurality of pens or markers being received and retained in recesses provided in an article support member interconnected between two wall members.
Figure 2:
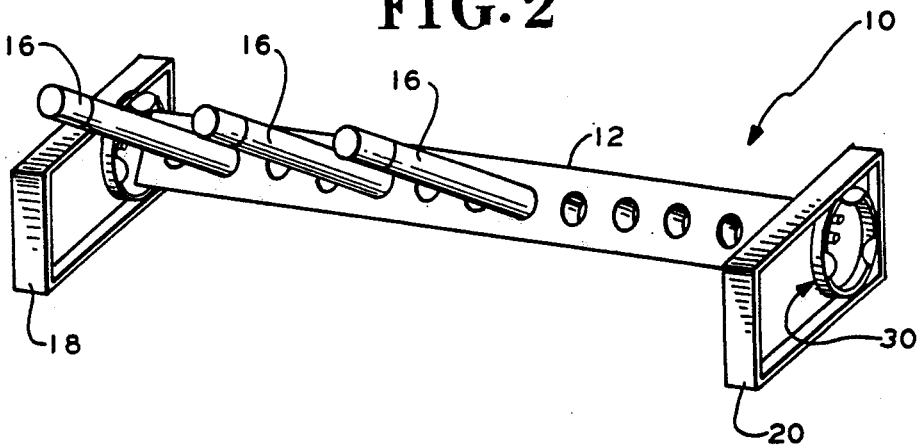
FIG. 2 is a perspective view similar to FIG. 1 but showing the article support member and the pens or markers rotated downwardly with respect to the position shown in FIG. 1.

Referring now to the drawings, and in particular to FIGS. 1 and 2, there is illustrated an article support stand identified by general numerical designation 10 which embodies the present invention. The article support stand 10 includes an article support member 12 provided, in the preferred embodiment, with a plurality of recesses 14 for receiving and temporarily retaining, such as for example, a plurality of pens or markers 16. The modular stand 10 may further include a pair of wall members 18 and 20 between which the article support member 12 is interconnected removably and rotatably by the interconnecting apparatus of the present invention described in detail below.

Figure 3:
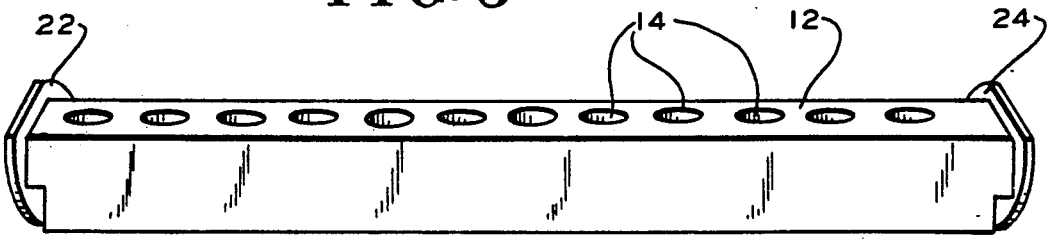
FIG. 3 is an enlarged perspective view of an article support member of the present invention.

Referring now in particular to the interconnecting apparatus of the present invention, and referring in particular to FIGS. 3–7, the article support member 12 is shown alone in FIG. 3 and it will be noted that the opposite ends or end portions of the article support member 12 are provided with generally semi-circular disc-like male portions or members 22 and 24 of the present invention. The configuration or shape of such male portions or members may be better understood by reference to FIG. 4 wherein it will be noted that representative male portion or member 22 is generally semi-circular and disc-like in shape and includes an outwardly extending generally semi-circular peripheral portion indicated by numerical designation 25 in which an inwardly extending indentation 26 is provided and located generally mid-point of the peripheral portion 25.

Figure 5:
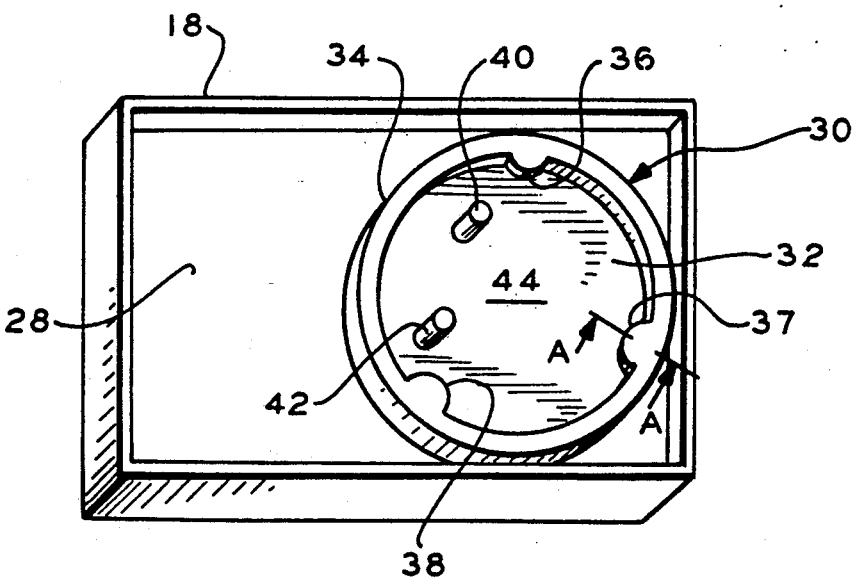
FIG. 5 is an enlarged perspective view of one side of a wall member of the present invention.
Figure 5A:
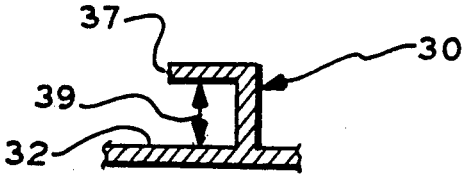
FIG. 5A is a cross-sectional view taken generally along the line A—A in FIG. 5.
Figure 6:
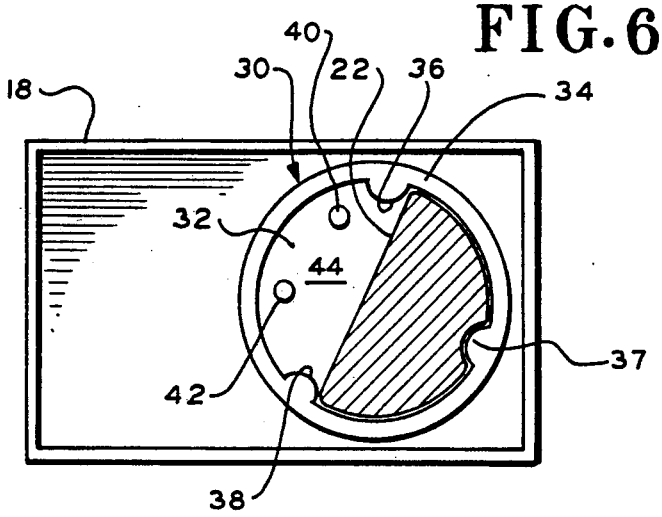
FIG. 6 is a diagrammatical view showing a generally semi-circular disc-like male member of the present invention aligned with and received within a recess provided in the generally cylindrical female member of the present invention.

The shape and structure of the wall members 18 and 20 may be better understood by reference to FIG. 5 wherein the shape and structure of representative wall member 18 is shown in greater detail. As may be understood by reference to FIG. 5, wall member 18 includes a side or side portion 28 provided with a generally cylindrical female member of the present invention which is identified by general numerical designation 30. In the preferred embodiment, female member 30 includes a bottom or bottom portion 32 circumscribed by an outwardly extending cylindrical wall 34 provided, in the preferred embodiment, with a plurality of inwardly extending tabs 36, 37 and 38, and it will be understood by reference to FIG. 5A and representative inwardly extending tab 37 that the underside of the tabs 36, 37 and 38 are spaced from the bottom 32 of the female member 30 a distance indicated by the arrow 39 in FIG. 5A. In further reference to FIG. 5, it will be further understood that the female member 30 may further include a pair of posts 40 and 42 located within the cylindrical wall 34 and extending outwardly from the bottom 32. It will be particularly understood by reference to FIG. 5 that the bottom 32, cylindrical wall 34 and the undersides of the tabs 36, 37 and 38 cooperatively define a recess indicated by numerical designation 44 for receiving, for example, the generally semi-circular disc-like male portion or member 22 as illustrated diagrammatically in FIGS. 6 and 7.

Figure 4:
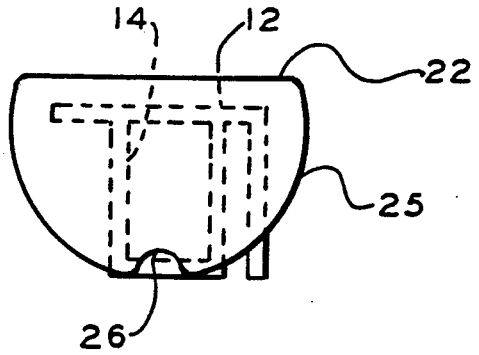
FIG. 4 is a left end view of the article support member shown in FIG. 3.
Figure 7:
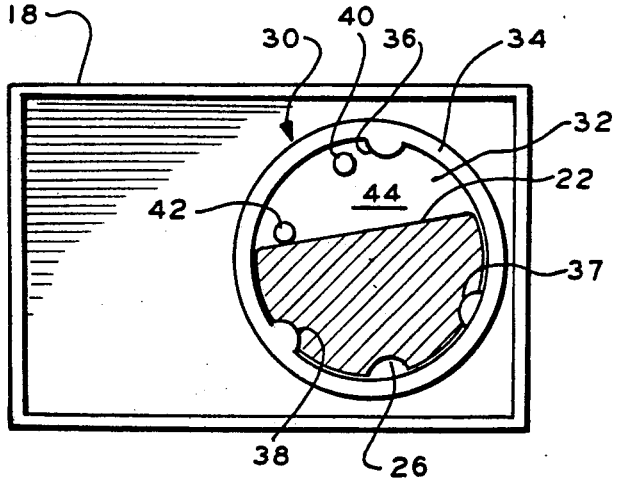
FIG. 7 is a view similar to FIG. 6 but showing the male member of FIG. 6 rotated clockwise with respect to the position therefor shown in FIG. 6.

Referring now to FIGS. 6 and 7, and again to FIG. 4, it will be understood that the indentation 26 provided at the mid-point of the peripheral portion 25 of the male member 22 and central tab 37 of the female member 30, note FIG. 6, cooperatively function as aligning means for facilitating the insertion of, for example, representative male member 22 into the recess 44 of representative female member 30. To retain the male member 22 in the recess 44 of female member 30, the male member 22 may be rotated either clockwise or counterclockwise to cause a portion of the outer peripheral portion 25 (FIG. 4) of the male member 22 to reside under the tabs, such as for example reside under tabs 37 and 38 as illustrated in FIG. 7 upon the male member 22 being received within the recess 44 and rotated clockwise with respect to the female member 30 as viewed in FIG. 7. As may be better understood by reference to FIG. 7, posts 40 and 42 function as stop or limiting means for limiting the clockwise and counterclockwise rotation of the male member 22 in the recess 44. It will be further understood from FIG. 7, in connection with FIG. 2, that the article support member 12 may be rotated with respect to and maintained at different angles with respect to the wall members 18 and 20 due to the interference fit between the male member 22 between the undersides of the inwardly extending tabs, such as tabs 37 and 38 as shown in FIG. 7, and the bottom 32 of the female member 30. More particularly, it will be understood that the thickness of the generally semi-circular disc-like male member 22 is slightly larger than the distance 39, shown in FIG. 5A, between the underside of representative tabs 37 and the bottom 32 of female member 30. Such interference fit is sufficiently loose to permit the male members to rotate within the recesses 44 but is sufficiently tight to cause the male members, and hence the article support member 12, to be retained at any position of clockwise or counterclockwise rotation permitted by the posts 40 and 42. This permits the article support member 12 to receive and retain articles, such as the plurality of pens or markers 16 shown in FIGS. 1 and 2, at different angles with respect to the wall members 18 and 20 and thereby at different angles with respect to a support surface on which the article support stand of the present invention may reside and thus at different angles with respect to a person viewing or utilizing the support stand of the present invention.

Figure 8:
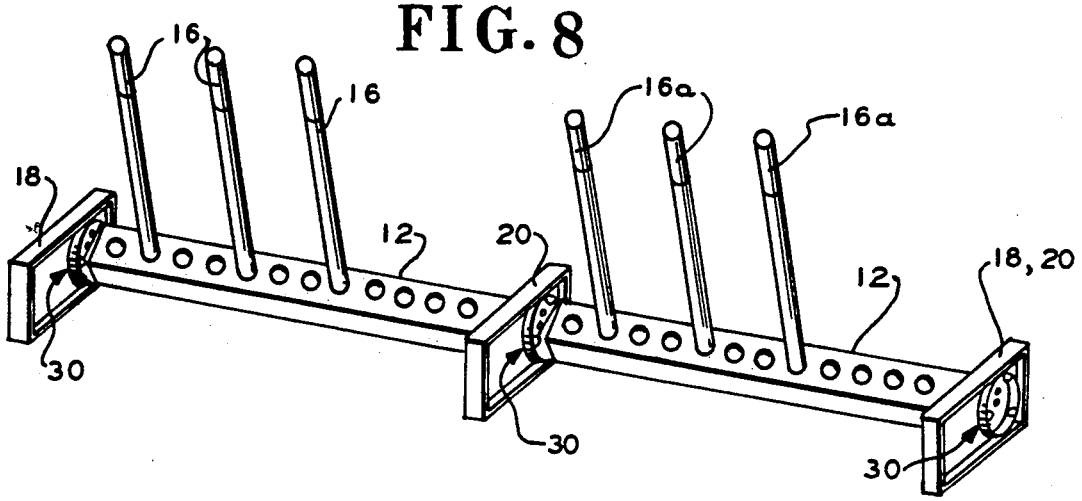
FIG. 8 is a perspective view illustrating the modularity of the article support stand of the present invention.

The modularity of the article support stand of the present invention may be understood by reference to FIG. 8 and by a further understanding of the teachings of the present invention wherein it will be understood that the wall members 18 and 20 of FIGS. 1 and 2 are identical and that the wall members shown in FIGS. 1 and 2 were given different numerical designations merely for convenience of reference. Thus it will be understood that the wall members are identical and interchangeable. It will be further particularly understood that female members 30, as shown in detail in FIG. 5 and described above, are provided on both opposed sides of each wall member whereby each wall member of the present invention may be utilized, as illustrated in FIGS. 1 and 2, to support a single article support member 12 or to support a plurality of article support members 12 in modular fashion as illustrated in FIG. 8. Thus, it will be understood that the rightward wall member shown in FIG. 8 may be identified by either numerical designation 18 or 20. In brief summary, it will be understood that the wall members of the present invention are identical and that there is neither a right nor left wall member and that each wall member may function as either a right or left end wall member as illustrated in FIGS. 1 and 2, a right or left extreme end wall member as illustrated in FIG. 8, or an intermediate or central wall as illustrated with regard to the wall member identified by numerical designation 20 in FIG. 8. Thus, it will be understood from FIG. 8 that the article support stand of the present invention is modular and that as additional articles, such as additional articles **16*a* shown in FIG. 8 are added, an additional article support member 12 may be interconnected between the wall member identified by numerical designation 20 in FIG. 8 and the rightward end wall member shown in FIG. 8 which, as noted above, may be identified by either numerical designation 18 or 20**.

It will be further understood in accordance with the teachings of the present invention that the male members in the preferred embodiment are provided on the opposite or opposed ends of the article support member 12 and that the female members are provided on both of the opposite or opposed sides of the wall members; however, this may be reversed and the male members may be provided on both opposite or opposed sides of the wall members and the female members may be provided on the opposed or opposite ends of the article support member. In the preferred embodiment the article support member and wall members were made of a suitable plastic, such as for example high impact polystyrene, and may be made, for example, by suitable injection molding techniques known to those skilled in the art.

It will be further understood that many variations and modifications may be made in the present invention without departing from the spirit and scope thereof.

What is claimed is:

1. An article support stand, comprising:

at least one article support member provided with means for receiving and retaining at least one article;

at least a pair of wall members;

interconnecting means for removably and rotatably interconnecting said article support member between said wall members, said interconnecting means including a generally semi-circular disc-like male portion and a generally cylindrical female portion;

said male portion including a generally semi-circular outer peripheral portion provided with an indentation approximately mid-point thereof;

said female portion including a bottom circumscribed by an outwardly extending cylindrical wall provided with at least one inwardly extending tab spaced from said bottom and complementary in shape to said indentation, said bottom, said cylindrical wall and said tab defining a recess for receiving said male portion, said tab for retaining said male portion within said recess upon said male portion being received within said recess and rotated with respect to said female portion; and said indentation and said tab for aligning said male portion with said recess to facilitate entry of said male portion into said recess.

2. The stand according to claim 1 wherein an interference fit is provided between said male portion and said bottom and said tab of said female portion to permit said article supporting member to be rotated and maintained at a plurality of different angles with respect to said wall members.

3. The stand according to claim 1 wherein said means for receiving and retaining at least one article comprise a plurality of inwardly extending recesses provided within said article support member for removably receiving and temporarily retaining a plurality of said articles.

4. The stand according to claim 1 wherein said female portion further includes stop means located within said cylindrical wall and which stop means limit both clockwise and counterclockwise rotation of said male portion within said recess.

5. The stand according to claim 4 wherein said stop means comprise a pair of posts extending outwardly from said bottom and located within said cylindrical wall.

6. A modular article support stand, comprising:

at least two article support members each including opposed end portions and each support member including a portion providing means for temporarily receiving and retaining at least one article;

at least three wall members each provided with opposed side portions;

interconnecting means for removably and rotatably interconnecting each of said article support members between two of said wall members, said interconnecting means including a generally semi-circular disc-like male member and a generally cylindrical female member providing a recess for rotatably receiving said male member and said female member provided with retaining means for retaining said male member within said recess upon said male member being received within said recess and rotated with respect to said female member;

said male member including a generally semi-circular outer peripheral portion provided with an indentation approximately mid-point thereof;

said female member including a bottom circumscribed by an outwardly extending cylindrical wall provided with at least one inwardly extending tab spaced from said bottom and complementary in shape to said indentation, said bottom, said cylindrical wall and said tab defining a recess for receiving said male member, said tab for retaining said male member within said recess upon said male member being received within said recess and rotated with respect to said female member, and said indentation and said tab for aligning said male member with said recess to facilitate entry of said male member into said recess; and one of said male and female members provided on both of said opposed end portions of each of said article support members and the other of said male and female members provided on both of said opposed side portions of each of said wall members.

* * * * *